US007254925B2

(12) United States Patent
Stefanutti et al.

(10) Patent No.: US 7,254,925 B2
(45) Date of Patent: Aug. 14, 2007

(54) INSULATED WALL ASSEMBLY

(75) Inventors: Oscar Stefanutti, Bloomfield, MI (US); Timothy Alvaro, Venice, FL (US); Paul Stefanutti, Bloomfield Village, MI (US); John Willwerth, Bloomfield, MI (US)

(73) Assignee: Efficient Building Systems, L.L.C., Birmingham, MI (US)

( * ) Notice: Subject to any disclaimer, the term of this patent is extended or adjusted under 35 U.S.C. 154(b) by 596 days.

(21) Appl. No.: 10/623,670

(22) Filed: Jul. 21, 2003

(65) Prior Publication Data

US 2004/0016194 A1 Jan. 29, 2004

Related U.S. Application Data

(63) Continuation-in-part of application No. 09/795,662, filed on Feb. 28, 2001, now Pat. No. 6,622,452, which is a continuation-in-part of application No. 09/246,977, filed on Feb. 9, 1999, now abandoned.

(60) Provisional application No. 60/299,068, filed on Aug. 30, 2000.

(51) Int. Cl.
*E04B 2/40* (2006.01)
*E04B 2/86* (2006.01)

(52) U.S. Cl. ..... 52/309.9; 52/309.11; 52/236.5; 52/576; 52/425; 249/35; 249/39

(58) Field of Classification Search ..... 52/425, 52/426, 742.15
See application file for complete search history.

(56) References Cited

U.S. PATENT DOCUMENTS 718,429 A * 1/1903 Conway ..... 249/26
1,400,682 A * 12/1921 Keogan ..... 249/21
1,616,977 A 2/1927 Koivu
1,863,549 A * 6/1932 Lockwood ..... 264/35
2,515,977 A * 7/1950 Banneyer ..... 249/39
3,145,505 A 8/1964 Cornelius
3,279,137 A * 10/1966 Pavlecka ..... 52/275

(Continued)

FOREIGN PATENT DOCUMENTS

JP 4-124374 * 4/1992

(Continued)

OTHER PUBLICATIONS

U.S. Appl. No. 09/781,724, filed Feb. 12, 2001, entitled "Insulated Concrete Wall Construction Method and Apparatus".

*Primary Examiner*—Robert Canfield
(74) *Attorney, Agent, or Firm*—Carlson, Gaskey & Olds

(57) ABSTRACT

A concrete form panel has a plurality of studs. A first and second panel are fastened to the studs to define concrete receiving cavities between the first panel and the second panel. A fastening strip attaches the panels to the stud and is vertically oriented. In addition, a netting may span the studs. An opening extending from panel to panel may create a concrete-to-concrete interface between concrete in the form panel and a concrete footing. A column may be formed in this fashion. Moreover, ports, such as windows and door, may be provided in wall assembly. The assembly may be attached by a truss anchor to a truss for a roof.

10 Claims, 12 Drawing Sheets

U.S. PATENT DOCUMENTS 3,344,572 A * 10/1967 Sell ..... 52/426
3,440,785 A * 4/1969 Denny et al. ..... 52/275
3,562,970 A 2/1971 Schwartz
3,662,507 A * 5/1972 Espeland ..... 52/270
3,775,240 A * 11/1973 Harvey ..... 52/206
3,778,020 A 12/1973 Burrows et al.
3,788,020 A 1/1974 Gregori
3,828,502 A * 8/1974 Carlsson ..... 52/309.11
3,835,608 A 9/1974 Johnson
3,872,636 A 3/1975 Nicosia
3,918,223 A * 11/1975 Carlsson ..... 52/220.2
4,033,544 A 7/1977 Johnston
4,047,355 A 9/1977 Knorr
4,047,357 A * 9/1977 Mulholland et al. ..... 52/91.3
4,177,968 A 12/1979 Chapman
4,223,501 A 9/1980 DeLozier
4,314,431 A 2/1982 Rabassa
4,430,831 A * 2/1984 Kemp ..... 52/204.53
4,433,520 A 2/1984 Maschhoff
4,516,372 A 5/1985 Grutsch
4,532,745 A 8/1985 Kinard
4,590,729 A 5/1986 Hegazi
4,625,484 A 12/1986 Oboler
4,669,240 A 6/1987 Amormino
4,813,193 A * 3/1989 Altizer ..... 52/210
4,832,308 A 5/1989 Slonimsky et al.
4,866,891 A * 9/1989 Young ..... 52/105
4,869,037 A 9/1989 Murphy
4,888,931 A 12/1989 Meilleur
4,967,528 A 11/1990 Doran
5,140,794 A 8/1992 Miller
5,216,863 A 6/1993 Nessa et al.
5,274,975 A * 1/1994 Haag ..... 52/300
5,279,089 A * 1/1994 Gulur ..... 52/309.11
5,311,712 A * 5/1994 Accousti ..... 52/259
5,311,718 A * 5/1994 Trousilek ..... 52/425
5,323,578 A 6/1994 Chagnon et al.
5,371,990 A 12/1994 SalahUddin
5,471,806 A 12/1995 Rokhlin
5,488,806 A 2/1996 Melnick et al.
5,491,947 A 2/1996 Kim
5,522,194 A 6/1996 Graulich
5,526,625 A 6/1996 Emblin et al.
5,540,020 A 7/1996 Santini
5,566,521 A 10/1996 Andrews et al.
5,570,552 A 11/1996 Nehring
5,608,999 A * 3/1997 McNamara ..... 52/275
5,617,686 A 4/1997 Gallagher, Jr.
5,657,600 A 8/1997 Mensen
5,697,189 A * 12/1997 Miller et al. ..... 52/79.9
5,697,196 A 12/1997 SalahUddin
5,704,180 A 1/1998 Boeck
5,722,198 A * 3/1998 Bader ..... 52/745.09
5,724,782 A 3/1998 Rice et al.
5,729,942 A 3/1998 Moore, Jr.
5,735,090 A * 4/1998 Papke ..... 52/220.2
5,740,648 A * 4/1998 Piccone ..... 52/426
5,749,196 A 5/1998 Bangma
5,759,849 A 6/1998 Aoyagi et al.
5,771,648 A 6/1998 Miller et al.
5,771,654 A 6/1998 Moore et al.
5,809,725 A 9/1998 Cretti
5,819,489 A * 10/1998 McKinney ..... 52/435
5,839,243 A 11/1998 Martin
5,839,249 A 11/1998 Roberts
5,852,907 A 12/1998 Tobin et al.
5,860,262 A * 1/1999 Johnson ..... 52/426
5,887,401 A 3/1999 Moore, Jr.
5,974,751 A * 11/1999 De Zen ..... 52/439
6,041,561 A 3/2000 LeBlang
6,076,323 A 6/2000 Chui
6,085,476 A 7/2000 Jantzi et al.
6,145,263 A * 11/2000 Eckerd ..... 52/508
6,189,269 B1 * 2/2001 De Zen ..... 52/220.5
6,247,280 B1 6/2001 Grinshpun et al.
6,263,628 B1 * 7/2001 Griffin ..... 52/309.12
6,276,104 B1 8/2001 Long, Sr. et al.
6,351,918 B1 3/2002 Westra et al.
6,363,683 B1 4/2002 Moore, Jr.
6,401,413 B1 6/2002 Niemann
6,401,417 B1 6/2002 Leblang
6,412,231 B1 * 7/2002 Palatin ..... 52/79.1
6,438,923 B2 8/2002 Miller
6,550,194 B2 * 4/2003 Jackson et al. ..... 52/215
6,622,452 B2 * 9/2003 Alvaro ..... 52/742.14
6,854,230 B2 * 2/2005 Starke ..... 52/481.1
6,880,304 B1 * 4/2005 Budge ..... 52/426

FOREIGN PATENT DOCUMENTS

JP 4-277264 * 4/1992

* cited by examiner

INSULATED WALL ASSEMBLY

CROSS REFERENCE TO RELATED APPLICATIONS

This application is a continuation-in-part of U.S. Non-Provisional Patent Application Ser. No. 09/795,662 filed Feb. 28, 2001 now U.S. Pat. No. 6,622,452, which claims priority to U.S. Provisional Patent Application U.S. Ser. No. 60/229,068, filed Aug. 30, 2000 and is a continuation-in-part of U.S. Non-Provisional Patent Application Ser. No. 09/246,977, filed Feb. 9, 1999 now abandoned.

BACKGROUND OF THE INVENTION

This invention relates to an insulated concrete wall assembly.

Insulating concrete form (ICF) systems are known for use in constructing exterior wall systems with high performance and environmentally friendly materials that have vastly improved the energy efficiency, air quality, durability and overall comfort of dwelling structures. One example of such a system is disclosed in U.S. Pat. No. 4,223,501 issued Sep. 23, 1980 to DeLozier (the DeLozier patent). The DeLozier patent discloses an insulated concrete wall form comprising a plurality of blocks arranged in stacked courses. Each block includes a pair of insulating panels in a spaced parallel disposition. The panels of each block are held together by vertically oriented steel panels. However, stacked courses of blocks are time-consuming to construct.

Another known type of insulating concrete form system is disclosed in U.S. Pat. No. 5,809,725 issued Sep. 22, 1998 to Cretti (the Cretti patent). The Cretti patent discloses an insulated concrete wall panel form that includes a framework of interconnected wires holding two insulated panels in a spaced parallel disposition. Similarly, U.S. Pat. No. 5,852,907 issued Dec. 29, 1998 to Tobin, et al. discloses an insulated concrete wall panel form design that includes a framework of steel reinforcing rods and form ties that interlock parallel foam panels. However, the interconnecting wires and rods are difficult and time consuming to assemble with insulating panels.

U.S. Pat. No. 5,839,249 issued Nov. 24, 1998 to Roberts (the Roberts patent) discloses vertically oriented interconnected steel studs that extend through vertically oriented openings in stacked form concrete form blocks in an insulating concrete wall panel structure. These vertically oriented studs are used to help vertically align the stack of foam blocks and are inserted through cylindrical cavities that are alternated with other cylindrical cavities into which concrete is poured.

Both U.S. Pat. Nos. 4,033,544 and 6,085,476 disclose fabricating insulated concrete wall panel forms, transporting these forms to a worksite, and connecting the panels together before pouring concrete into them.

More recently, patents have issued relating to the construction of insulated wall panel assemblies to LeBlang, U.S. Pat. No. 6,401,417 B1 and U.S. Pat. No. 6,041,561 (the LeBlang Patents). The LeBlang Patents relate to concrete form structures made of insulated wall panels secured to elongate facing channels. A base plate seats the facing channels.

The foregoing designs each have drawbacks that limit their adoption and implementation into the housing market. These wall assemblies lack certain features that permit their ready incorporation into large scale housing projects and are relatively very expensive to produce and construct. Consequently, their use has been limited to the upper spectrum of the housing market.

A need therefore exists for an improved wall assembly with features that accommodate the needs of these markets.

SUMMARY OF THE INVENTION

The present invention comprises a concrete wall assembly having features that address the needs of the commercial and residential housing markets. The invention incorporates a concrete form having two panels. Each panel sandwiches a frame of studs to define concrete receiving cavities between the first panel and the second panel and the studs. Applicant has discovered by pouring concrete into vertically erected receiving cavities at a job site, the cost of employing its inventive wall assembly is greatly reduced. Accordingly, many of its inventive features facilitate construction in this manner.

For example, in contrast to existing wall assemblies, the inventive wall panel assembly has a vertically oriented fastening strip that attaches at least one of the panels to the frame. The fastening strip may attach the panel to a stud of the frame. Insulating panels as well as cementitious panels may be used with the inventive assembly. By orienting the fastening strip vertically, the inventive wall assembly prevents concrete from seeping between the panel and the stud when the concrete is poured into a vertically erected wall assembly.

In addition, the inventive concrete wall assembly has an opening at the bottom that permits concrete to pour vertically from the frame to a concrete footing. Unlike existing assemblies, this opening extends from panel to panel and allows the concrete in the wall assembly to cure on the footing without any intervening plate to degrade the connection between the concrete wall and the concrete footing. To further improve this connection, a groove may be provided in the concrete footing to create a form for a keyway for the vertically poured concrete. A reinforcing member, such as a metal rod, may be embedded in both the concrete wall and the concrete footing to strengthen this connection between the concrete wall and the concrete footing.

The insulated concrete form panel may also employ a netting spanning the studs. The netting is used to prevent concrete from bursting through the walls of the panel during the pouring of the concrete into the vertically erected wall assembly. The netting may be a cloth mesh. Moreover, the netting may be embedded in the panels themselves or sandwiched between a panel and the studs.

The invention may further encompass a vertically erected column constructed of a frame of studs. Two panels and the studs define a concrete receiving cavity. The panels may be cementitious. The studs may be steel studs. A concrete footing may be mounted to the column. In addition, a reinforcing member may extend between the concrete footing and the column.

Another important feature for the commercialization of the inventive wall assembly includes the incorporation of a port, such as a window or door, as part of the wall assembly. The studs are vertically erected and spaced apart to form a port. The studs are then sandwiched by a first panel and a second panel to form a first concrete receiving cavity forming one side of the port and a second concrete receiving cavity forming a second side of the port. In contrast to existing designs, the inventive wall assembly has cavities open to receive concrete along the vertical direction of the studs. The concrete is poured into the first concrete receiving cavity and the second concrete receiving cavity. By pouring concrete to form the door or window along the vertical direction of the studs, the inventive wall assembly allows the window or door to be formed following erection of the wall assembly at the construction site, thereby reducing construction costs.

Concrete may be poured along the vertical direction into a third concrete receiving cavity to form a header for the door or window. In addition, concrete may be poured along the vertical direction into a fourth concrete receiving cavity to form the lower portion of a window opening. A form may be placed on the fourth concrete receiving cavity to create an indentation to receive a window frame.

The concrete wall assembly may thus comprise a frame having studs that extend along a vertical direction. Panels are fastened to each side of the frame to form a concrete receiving cavity. The frame has a space for a port as well as a concrete receiving cavity defining the top or bottom of the port. The concrete receiving cavity is open to receive concrete along the vertical direction of the studs.

The invention further comprises a frame made of studs with a first panel and a second panel fastened to the studs to form a concrete receiving cavity between the first panel, the second panel and the studs. A reinforcing member connects the studs. In addition, the frame of the studs is firmly connected to a truss for a roof by a truss anchor that connects the truss to the reinforcing member. This wall assembly thereby creates a strong connection between the truss and the frame.

The truss anchor may be a hook. The hook has an opening to receive the reinforcing member. The opening may be expandable between a first dimension and a second dimension. The first dimension is greater than a dimension of the reinforcing member and the second dimension is less than the dimension of the reinforcing member. This feature permits the hook to be quickly attached around the reinforcing member to facilitate assembly of the wall to a roof truss. The truss anchor may then be embedded in concrete to further strengthen the connection between the wall and the roof.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
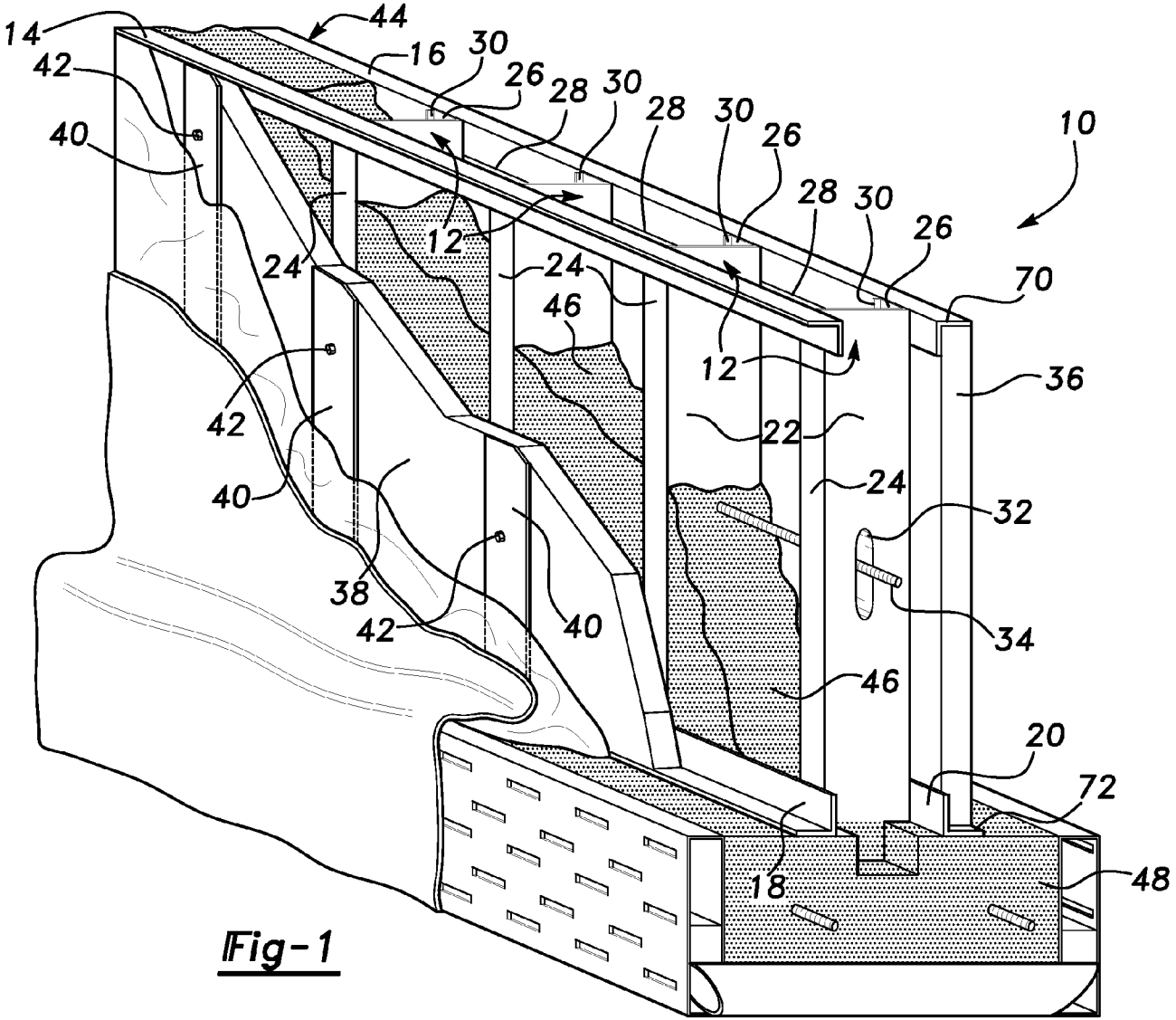
FIG. 1 illustrates a perspective cut-away view of an insulated wall panel constructed according to the invention and partially filled with concrete.

An insulated concrete 46 wall construction assembly constructed according to this invention is shown at 10 in the drawings. The assembly 10 includes a series of 18 gauge steel studs 12 oriented vertically and parallel to one another spaced approximately ten inches apart on center. The studs 12 are held in place relative to one another by 20 gauge steel angle strip cross members 14, 16, 18, 20 to form a frame or framework 21. Two top angle strips 14, 16 are fastened across the studs 12 at opposite sides of upper ends of studs 12 and two bottom angle strips 18, 20 are fastened across the studs 12 at opposite side of respective bottom ends of the stud 12.

Figure 2:
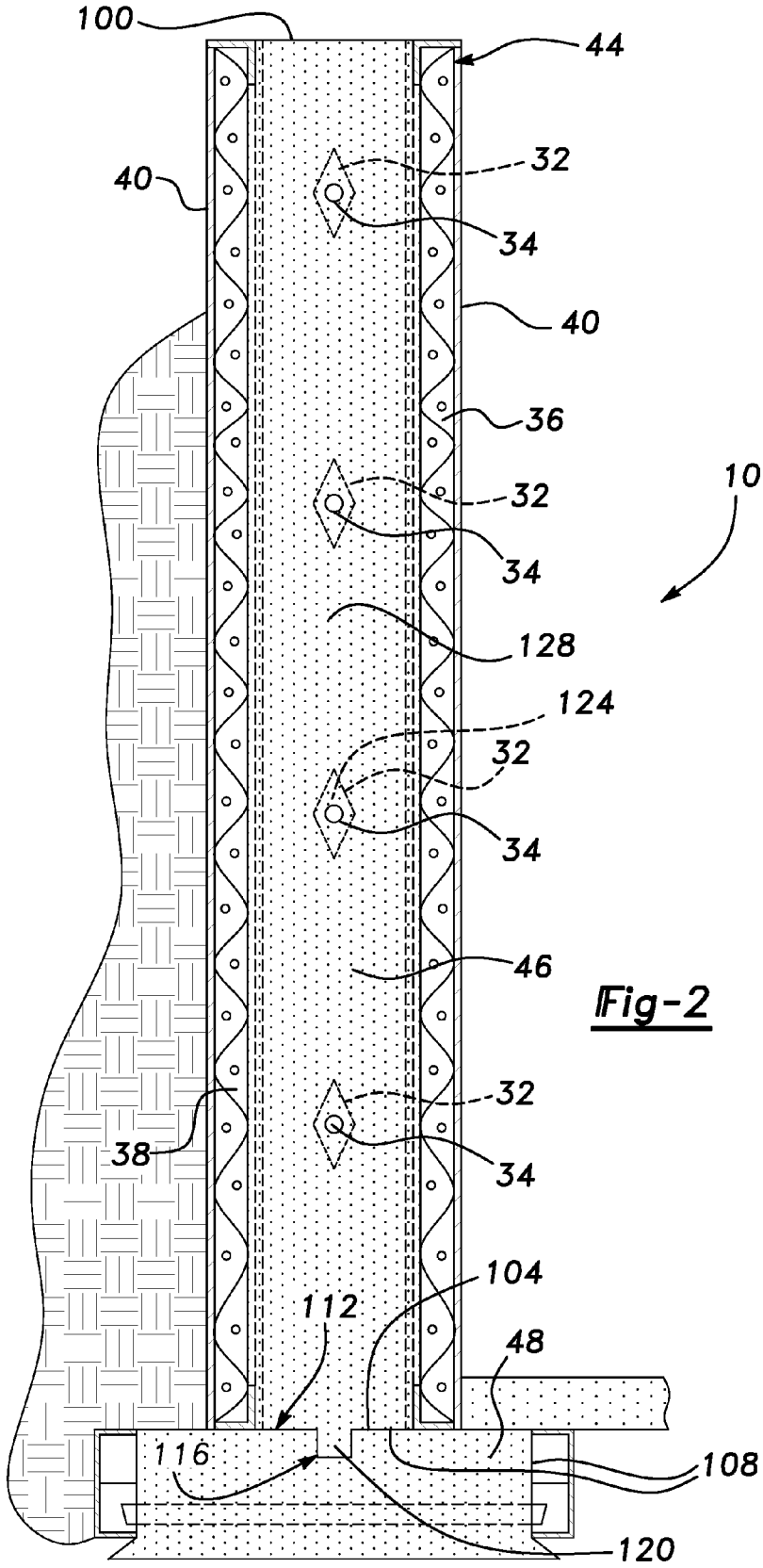
FIG. 2 is a cross-sectional side view of the insulated wall panel constructed according to the invention.

The studs 12 are of standard construction well known in the art and are formed from rolled steel. As best shown in FIG. 2, each stud 12 has a C-shaped cross-section and is formed to include an elongated main panel 22 and a pair of opposing flanges 24, 26 that extend integrally and perpendicularly from along the length of main panel 22 and provide stiffness to the studs. Inwardly directed elongated lips 28, 30 extend perpendicularly and integrally inward from along outer edges of each of the flanges 24, 26. The main panels 36, 38, 22 of the studs 12 are in a facing relationship to one another, i.e., the studs 12 are aligned such that side surfaces of the main panel 36, 38, 22 face one another. The studs 12 may be of whatever length is necessary for a given wall application.

Each stud 12 also includes a plurality of apertures 32 typically spaced two feet apart on center along the length of each stud 12. The apertures 32 of each adjacent stud 12 line up horizontally to accommodate the passage of a horizontal steel reinforcing rod 34 and concrete 46 to form concrete reinforcing member 124. A length of grade 60-3-8 inch steel reinforcing rod 34 extends horizontally through each set of corresponding apertures 32 in the adjacent studs 12. An inner sheet or panel 36 of commercially available insulating foam is fastened to a front or inner side of the framework 21 of steel studs 12 and a corresponding outer sheet or panel 38 of insulating foam is fastened to an opposite back or outer side of the framework 21 such that the two sheets 36, 38 of insulating foam are disposed parallel to one another. Each sheet of foam is preferably a two-inch thick sheet of extruded polystyrene. Sheets of extruded polystyrene are readily available from a number of sources such as the Dow Chemical Company. The panel 36 could also be plywood, PVC foam plastic, oriented strand board, a cementitious panel, or other suitable material.

As best shown in FIG. 1, the foam panel 36, 38 are secured to opposites of the framework 21 using approximately two-inch wide furring strips 40 and a plurality of fasteners 42 such as approximately three-inch long deck screws. Deck screws are the preferred fasteners 42 and they are readily available in large quantities and easy to install using standard self-loading power drills. The screw fasteners 42 are spaced approximately ten inches on center along each furring strip 40 and the furring strips 40 are oriented vertically against the outer surfaces of each of the insulating foam panels 36, 38 in alignment with side surfaces of each of the studs 12 in the framework 21. The fasteners 42 pass through furring strips 40, the insulating foam panels 36, 38 and then into the flanges 26, 28 at the sides of the studs 12. As such, the furring strips 40 distribute the loading of the fasteners 42 along vertical portions of the foam panels 36, 38 sandwiching the foam panels 36, 38 between the furring strips 40 and the flange portions 26, 28 of the studs 12.

The steel stud frame work 21, foam panels 36, 38, furring strips 40, and associated fasteners 42 make up an insulating concrete form panel (ICFP) 44 and a form that can be transported to a building site fastened together with other insulating concrete form panels 36, 38 interlaced with steel reinforcing rod 34 and filled with concrete 46 as will be described below. Each ICFP 44 is configured to rest upon a standard poured concrete footing 48 having exterior surface 108 and straddling the two-inch by three-inch keyway 120 at interface 112 that is formed into and runs along the centerline 116, a groove, of a standard concrete 46 footing 48. As shown, interface 112 extends between foam panel 36 and foam panel 38 creating an uninterrupted connection between concrete footing 48 and concrete 46 within ICFP 44.

Figure 3:
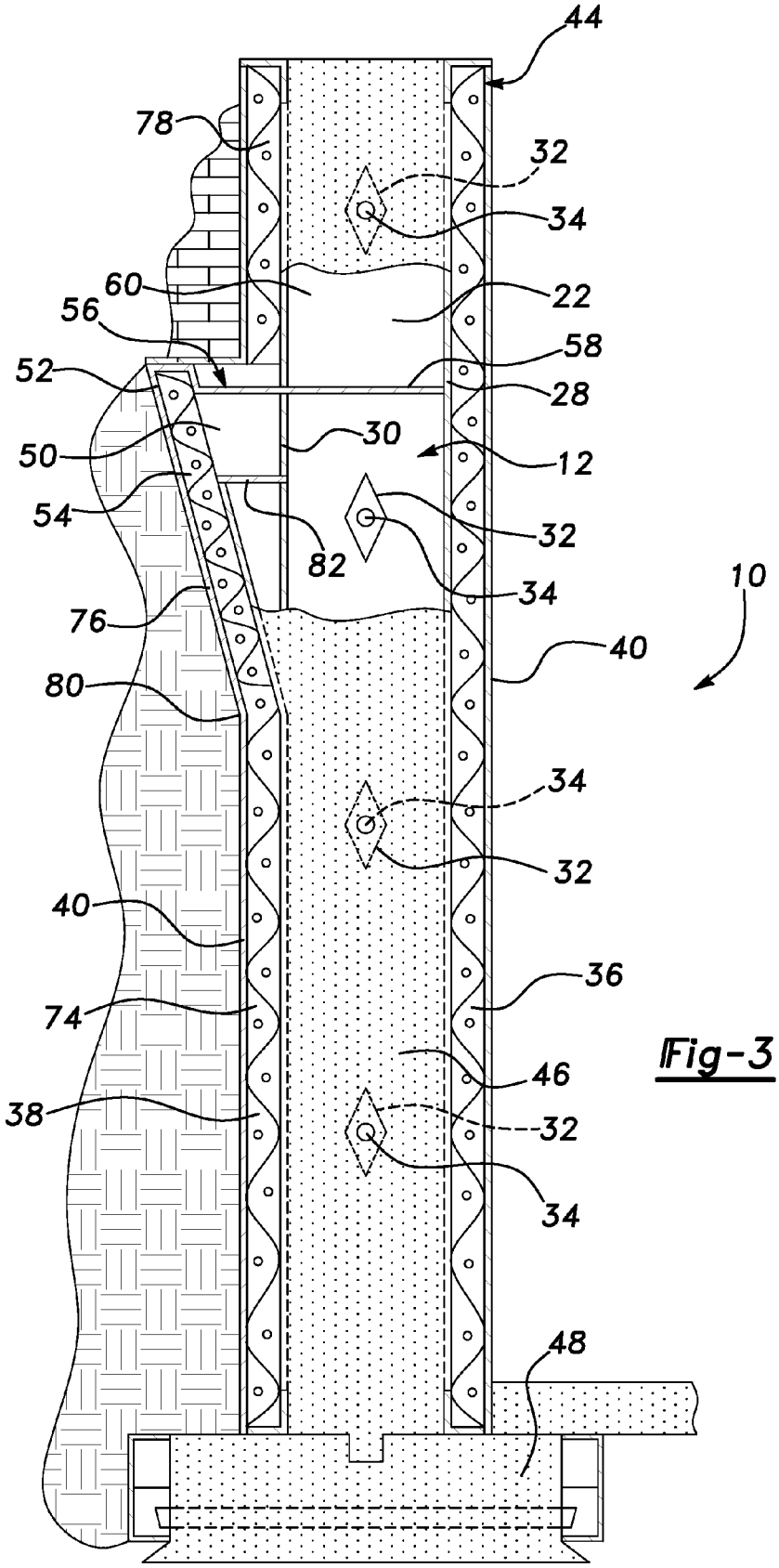
FIG. 3 is a partially cut-away cross-sectional side view of an insulated wall panel constructed according to the invention and including a brick ledge for supporting finishing material such as brick or stone above ground level.
Figure 5:
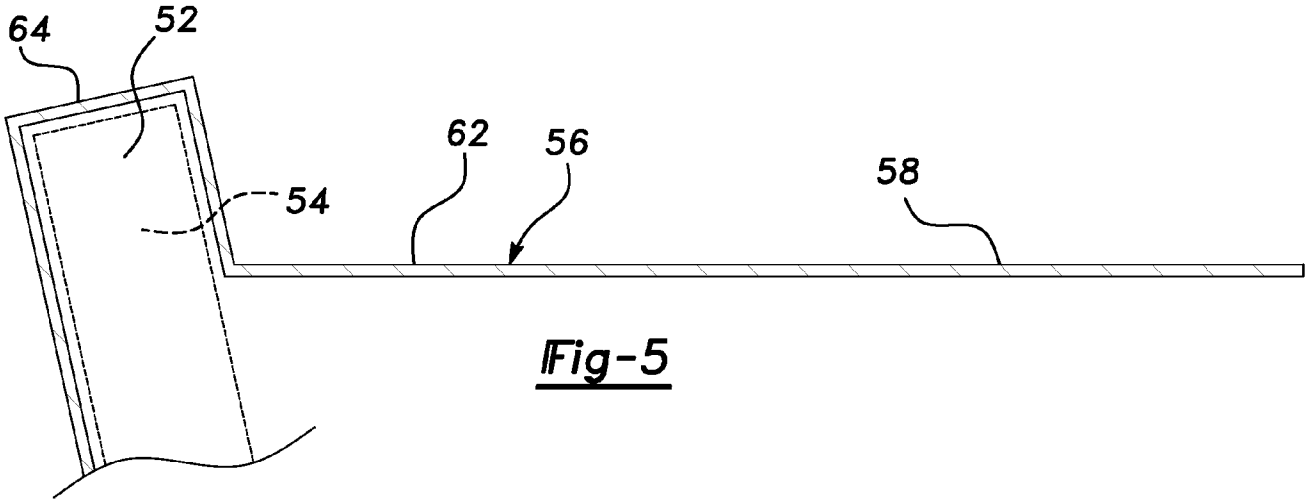
FIG. 5 is a side view of a brick ledge tie of FIG. 4.
Figure 6:
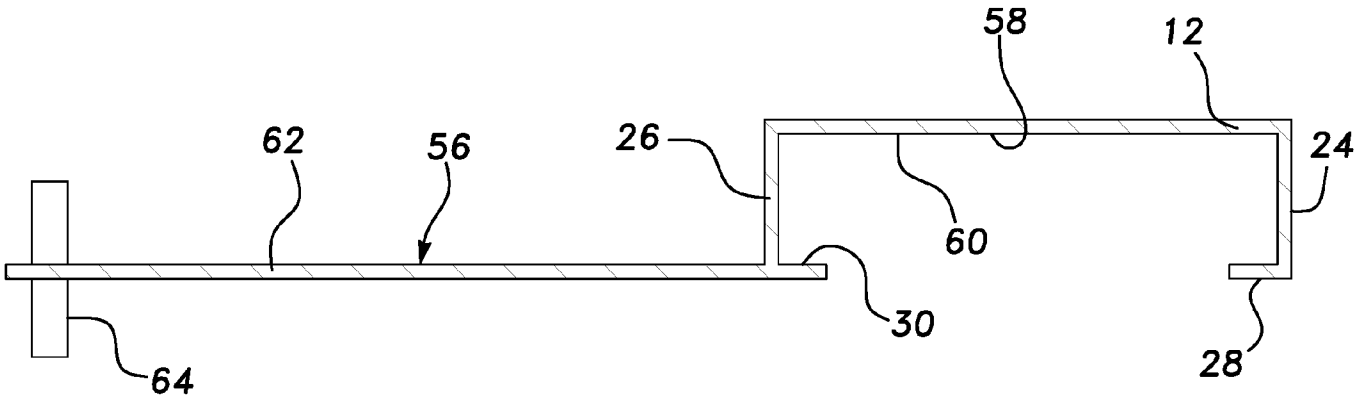
FIG. 6 is a top view of a bridge ledge tie of FIG. 4.
Figure 4:
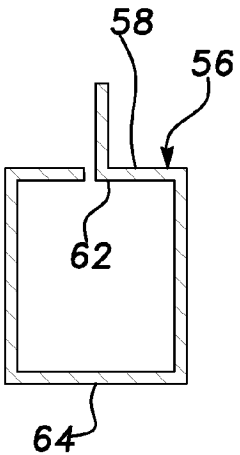
FIG. 4 is a front view of a brick ledge tie shown in FIG. 3.

As shown in FIG. 3, a brick ledge 50 can be formed to extend laterally from the outer surface of ICFP 44. The brick ledge 50 is approximately two feet high and angles outward and upward at an approximately 15-degree angle such that a top edge 52 of an outwardly extended portion 54 of the outer foam panel 38 is spaced approximately 4½ inches from the outer surface of the outer foam panel 38. The outwardly angled portion 54 of the foam panel is held in place by a plurality of brick ledged ties 56 as shown in FIGS. 4-6. Each brick ledged tie 56 is formed from a length of a number nine gauge steel wire and is bent to include generally U-shaped anchor portion 58 shaped to form an interference fit with a stud 12 when oriented horizontally within an interior surface 60 of a stud 12 between the inner and outer flanges 24, 26 of the stud 12 as shown in FIGS. 3 and 6. As shown in FIGS. 5 and 6, an arm portion 62 of each brick ledged tie 56 extends from the anchor portion 58 horizontally to the top outer edge 52 of the outwardly angled portion 54 of the outer insulator panel 38.

Each brick ledged tie 56 also includes a retainer portion 64 that extends from an outer end of the arm portion 62 and is configured to grasp the upper edge 52 of the outwardly angled foam panel portion 54. The retainer portion 64, as best shown in FIG. 4, is bent into a generally square shape to help distribute loads exerted by the brick ledge tie 56 on the upper edge 52 of the outwardly angled foam panel portion 54 once concrete 46 has been introduced into the ICFP 44. As shown in FIG. 5, the retainer portion 64 of the brick ledged tie 56 is angled to match the orientation of the outwardly angled portion 54 of the outer foam panel 38.

As shown in FIG. 6, the retainer portion 64 of the brick ledge tie 56 is shaped to closely match the contours of the inner wall 60 of the steel stud 12. Also shown in FIG. 6, the retainer portion 64 is also shaped to bend or wrap around the outer lip 30 extending from the outer flange 26 of a stud 12 and then to merge into the arm portion 62 and extend laterally outwardly in the general direction of the top edge 52 of the outwardly angled foam panel section 54. In practice, insulated concrete 46 wall 128 having top surface 100 and bottom surface 104 can be constructed according to the present invention by first constructing the framework 21 of steel studs 12. Framework 21 is constructed by first inserting a pair of angle strips 14, 18 into parallel spaced-apart slots formed in the flat top surface of a table. The slots are formed into the table so that the angle strips 14, 18 are held in parallel spaced-apart orientation at a distance generally equal to a desired height of the wall to be constructed. The studs 12 are then laid parallel to one another such that they extend horizontally across the two angle strips 14, 18 with downward-facing ones of their flanges 24 resting on top of the two angle strips 14, 18. The studs 12 are then attached to the angle strip 14, 18 using sheet metal screws driven through the downward-facing flange portion 24 of each stud 12 and into the angle strips 14, 18. The remaining two angle strips 16, 20 are then placed on the upward-facing flange portions 26 of the studs 12 opposite the two angle strips 14, 18 that have already been fastened to the studs 12. The remaining angle strips 16, 20 are then fastened to the studs in a like manner.

A form panel having a length and a width generally matching the corresponding length and width of a now completed framework 21 of steel studs 12 is then placed on the framework 21. The panel 36 is oriented such that upper and lower edges of the foam panel are retained by upwardly extending portion 70, 72 of each of the most recently fastened angle strips 16, 20. Furring strips 40 are then placed on the foam panel 36 in alignment with each of the steel studs 12 and are fastened in place as described above. The entire partially-completed panel is then flipped over and a second foam panel 38 of generally like dimension is similarly affixed to the newly upturned side of the framework 21.

If a brick ledge such as a brick ledge shown at 50 in FIG. 3, is to be formed in the panel, when the outer foam panel 38 is laid down, it is laid down in three separate horizontally oriented pieces 74, 76, 78. The three pieces are cut so as to completely cover the exposed outer side of the framework 21. A middle or mid-section 76 of the three sections is cut two feet in vertical width and has a horizontal length that generally extends a full width of the ICFP. The middle section 76 will eventually serve as an angled outer insulating wall 76 of a brick ledge 50. To leave the middle section 76 free to rotate outward at a later point during wall construction, the furring strips 40 are cut and attached to leave a two foot wide horizontal section of wall exposed. After the furring strips 40 are attached as described above, an additional furring strip 80 is fastened along a bottom edge of the two-foot wide section, perpendicular to the other furring strips 40. In addition, at horizontally-spaced points approximately vertically midway along the center portion of the foam panel, roofing screws 82 are driven through the foam and into the steel studs 12 beneath to secure the middle foam panel section during transport.

The now completed ICFPs 44 are then transported in this form to a job site by loading them onto a truck or other suitable conveyance. In the case of ICFPs 44 having bridge ledges 50, the two-inch wide foam panel sections 54 preferably remain secured until the ICFPs 44 have been unloaded at the job site and erected.

At the job site, each of the ICFPs 44 is placed on a standard footing 48 straddling a standard three inch wide by two inch deep keyway 120 that is generally formed along the approximate centerline 116 of a concrete 46 footing as shown in FIGS. 1-3. A lower end of each ICFP 44 is open to allow concrete 46 poured in a top end of each ICFP 44 to flow into the keyway 120 and lock the ICFPs 44 in position relative to the footing 48.

As each successive ICFP 44 is put in place, links of steel reinforcing rod 34 are inserted through the apertures 32 in the steel studs 12 such that the reinforcing rods 34 are disposed horizontally to one another and perpendicular to the studs 12. Adjacent panels 36, 38 are fastened together edge-to-edge with short length of furring strips 40 that are screwed into the existing vertical furring strips 40 of the adjacent ICFPs 44.

At this point, any ICFPs 44 that are configured to form bridge ledges 50 are set up for this purpose. To set up an ICFP to form a brick ledge 50, the roofing screws 82 securing the mid-panel section 54 are backed until the mid-panel section 54 forms an approximately fifteen degree angle with remainder of the outer surface of the outer film panel. At this point, the brick ledge ties 56 are installed by inserting the anchor portions 58 of each brick ledge tie 56 into one of the interior contours formed by the flanges 24, 26 and lips 28, 30 of each of the steel studs. The retainer portion 64 of each of the brick ledge ties 56 are then slipped over the top edge 52 of the mid-panel section 54.

At this point, any gaps or between the foam panel sections are filled with expanding foam adhesive. Concrete 46 is then pumped into cavities formed between the studs 12 and the foam panels 36, 38. In panels 36, 38 prepared to form brick ledges 50, the concrete 46 also flows outward against the outwardly angled foam panel portions to form a bridge ledge 50. Standard methods for ensuring there are no voids in the concrete 46 are then employed and may include the use of a vibrator submerged in the concrete 46.

Constructed in this manner, the brick ledge 50 provides a high degree of sheer force resistance to vertical loads placed on the brick ledge 50. The approximately two foot vertical height of the brick ledge 50 and the shallow fifteen degree outward angle provides a two foot high concrete cross-section that supports the brick ledge 50 against downwardly-applied vertical sheer forces. This construction alleviates the need to suspend steel reinforcing rods 34 within the brick ledge structure and also eliminates the time intensive task of installing such reinforcing rods.

Once the ICFPs 44 have been erected and joined to one another, a waterproofing membrane is sprayed on the outer surface of the ICFPs 44 and along the interface or joint between the ICFPs 44 and the footing. The waterproofing membrane may be anyone of a number of suitable such materials as are well known in the art and may be applied by anyone of a number of known suitable means. A drain mat is preferably affixed over the membrane to protect the membrane from damage that can be caused by back filling.

Figure 7:
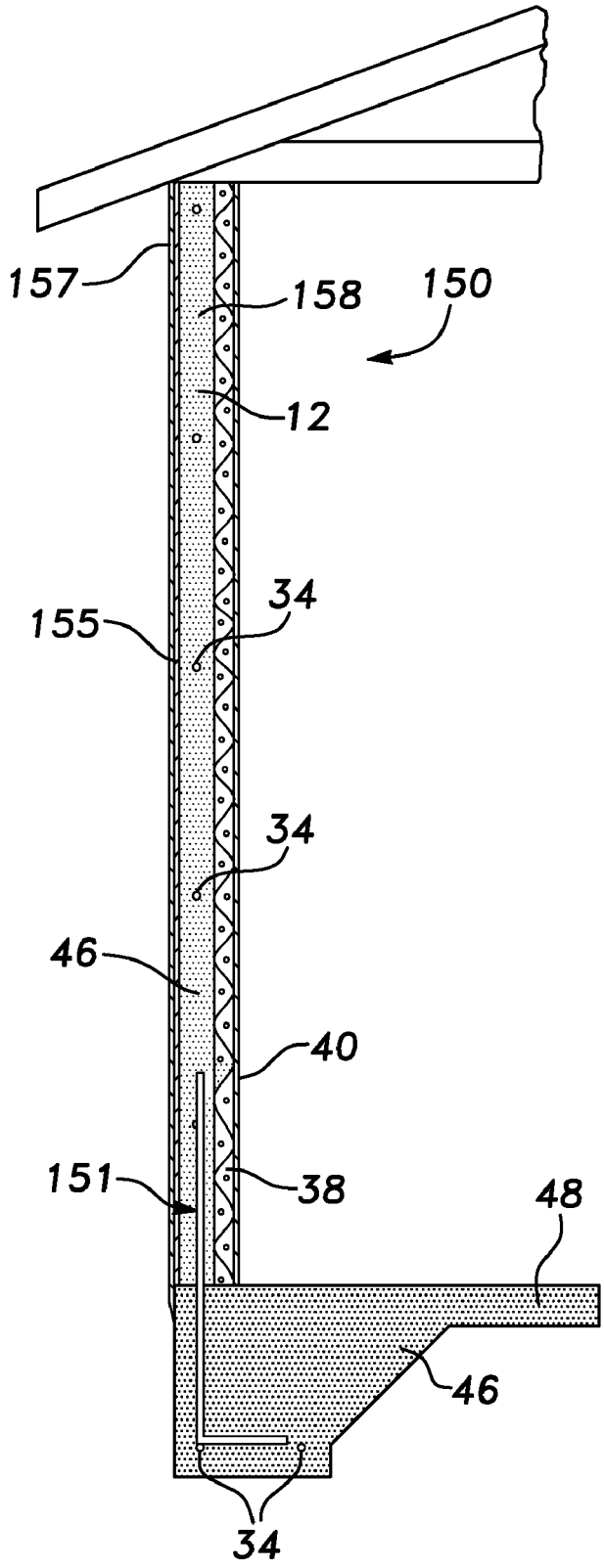
FIG. 7 is a cut-away side view of an insulated wall panel assembly with a cementitious panel.

FIG. 7 illustrates a side view of an alternative wall assembly 150. Here, concrete form wall assembly 150 has cementitious panel 155 made of 0.625 inch USG Fiber Rock™ exterior sheeting with cementitious coating 157. Cementitious coating 157 permits cement material, such as stucco, to adhere to cementitious panel 155 to allow for an alternative exterior surface. Cementitious panel 155 is spaced from second panel 38, which comprises an insulated foam panel as previously described. Like assembly 10, studs 12, second panel 38 and cementitious panel 155 form a concrete receiving cavity 158 to receive concrete 46. Studs 12 are connected to other studs by reinforcing rods 34 as previously explained. In addition, it should be noted that vertical fastening strips 40 attaches second panel 38, the insulating panel, to studs 12.

As further shown by FIG. 7, concrete form wall assembly 150 has footing 48 made of concrete 46. Reinforcing members 34 may extend through footing 48 to provide support. In addition, reinforcing rod 151 may extend between footing 48 and concrete 46 of wall assembly 150. In this way, wall assembly 150 is further secured to footing 48.

Figure 8:
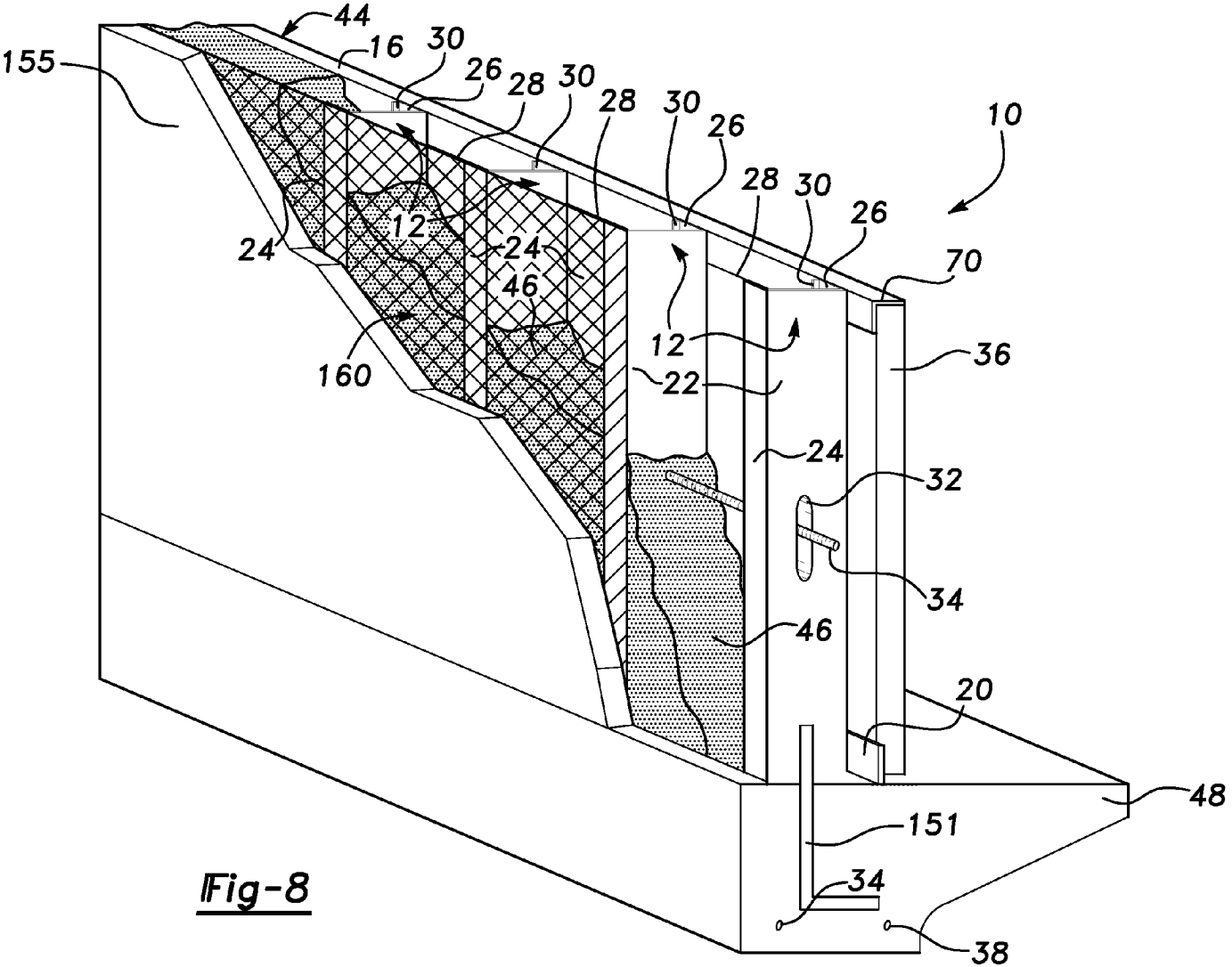
FIG. 8 is a perspective cut-away view of a wall panel assembly with netting spanning the studs.
Figure 9:
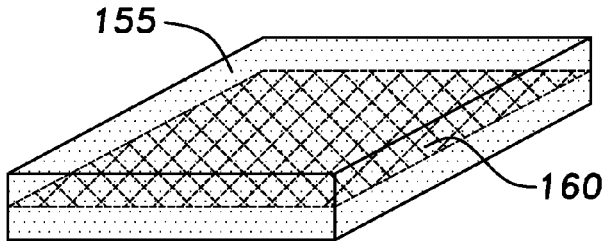
FIG. 9 is a cut-away perspective view of a panel with netting embedded therein.

As shown in FIG. 8, in the event cementitious panel 155 is employed rather than an insulating panel, the brittle nature of cementitious panel 155 may require netting 160 to be placed between cementitious panel 155 and studs 12. Netting 160 may comprise a cloth mesh that spans and is attached to studs 12 across each concrete receiving cavity. Netting 160 prevents concrete 155 from bursting through cementitious panel 155 as concrete is poured in the vertical direction along the direction indicated by arrow V. As shown in FIG. 9, netting 160 may be embedded in cementitious panel 155 itself.

Figure 10:
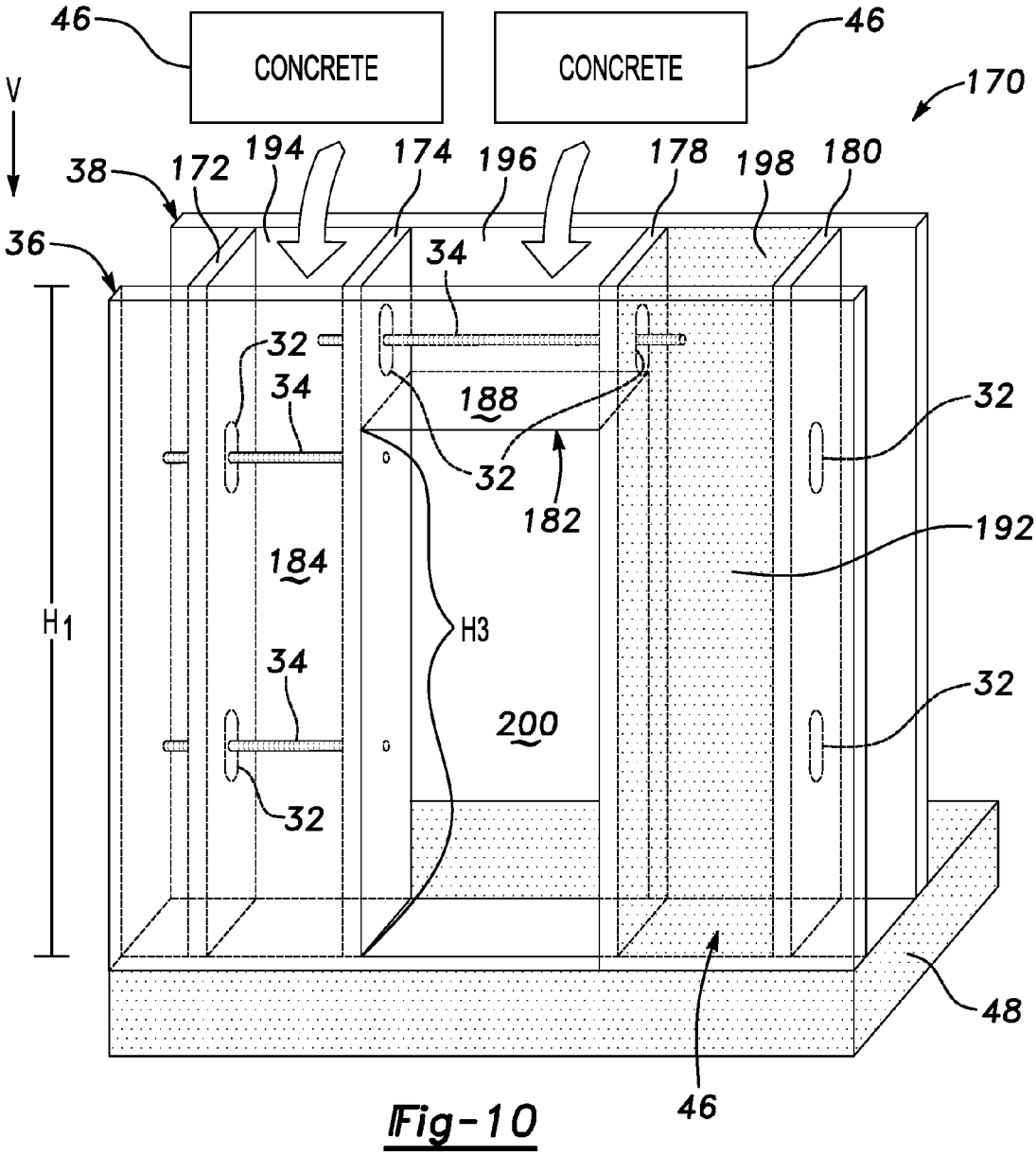
FIG. 10 illustrates a method of constructing a port for the inventive wall assembly.

FIGS. 10-13 illustrate the inventive wall assembly with a port, such as a door or window. Referring to FIG. 10, concrete wall assembly 170 has first panel 36 and second panel 38. First panel 36 and second panel 38 may comprise any of the materials previously described. The space between first panel 36 and second panel 38 are studs 172, 174, 178 and 180 erected along a vertical direction from ground. Studs 172, 174, 178 and 180 may comprise steel or other commonly available stud material and may be in the form of CEE channels or other planar shapes. Studs 172, 174, 178 and 180 are generally parallel to each other and perpendicular to first panel 36 and second panel 38. Studs 172, 174, 178 and 180 are spaced relative to each other and first panel 36 and second panel 38 so as to create three volumes to receive poured concrete poured along vertical direction of arrow V. First volume 184 is formed by first vertical stud 172 and second vertical stud 174 as well as first panel 36 and second panel 38. Foundation 46 serves to retain concrete 46 within first volume 184. Also shown are reinforcing members 34, which provides stability between first vertical stud 172 and second vertical stud 174 and may comprise rebar or other suitable support material. As shown, reinforcing members 34 extend through apertures 32 of vertical stud 172 and may connect through other vertical studs in this manner. First volume 184 has height H1 from foundation 48 to the desired height of wall.

Second volume 188 is formed by second vertical stud 174 spaced from third vertical stud 178. First panel 36 and second panel 38 form additional walls for second volume 188. Horizontal stud 182 forms the bottom of second volume 188 and is spaced at a desired height for a door. One or more reinforcing members 34 may be located in second volume 188 to provide support.

Third volume 192 is formed by third vertical stud 178 and fourth vertical stud 180 as well as first panel 36 and second panel 38. Foundation 48 serves to form the bottom of third volume 192.

Concrete may be poured into first volume 184, second volume 188 and third volume 192 along vertical direction as indicated by arrow V to desired height H1 through openings 194, 196 and 198, respectively. As shown, openings 194, 196 and 198 are opened to receive concrete 46 along vertical direction V along the vertically erected studs 172, 174, 178 and 180. In particular, in contrast to existing wall assemblies, concrete wall assembly 170 allows header for door opening 200 to be formed by pouring concrete along the vertical direction V. This greatly facilitates the construction of wall assembly 170 at the job site because concrete 46 may be poured into each volume 184, 188 and 192 following the erection of wall assembly 170 rather than having to fill concrete into the cavities horizontally and then transporting the wall assembly 170 with concrete to the job site for erection.

First panel 36 and second panel 38 each have material cut out to form the shape of door opening 200, here having height H3, the desired height of a doorway. In addition, concrete 46 is poured into second volume 188 at the top of door opening 200 at about height H3. When concrete 46 has dried in first volume 184, second volume 188 and third volume 182, concrete wall assembly 170 forms an extremely strong structure. Apertures 32 on studs 172, 174, 178 and 180 permit concrete to flow and form between volumes 184, 188 and 192. Reinforcing members 34 may be passed through apertures 32 to provide further strength to concrete wall assembly 170. In this way, door opening 200 is formed by first volume 184, second volume 188, third volume 192 as well as by footing 48.

Figure 11:
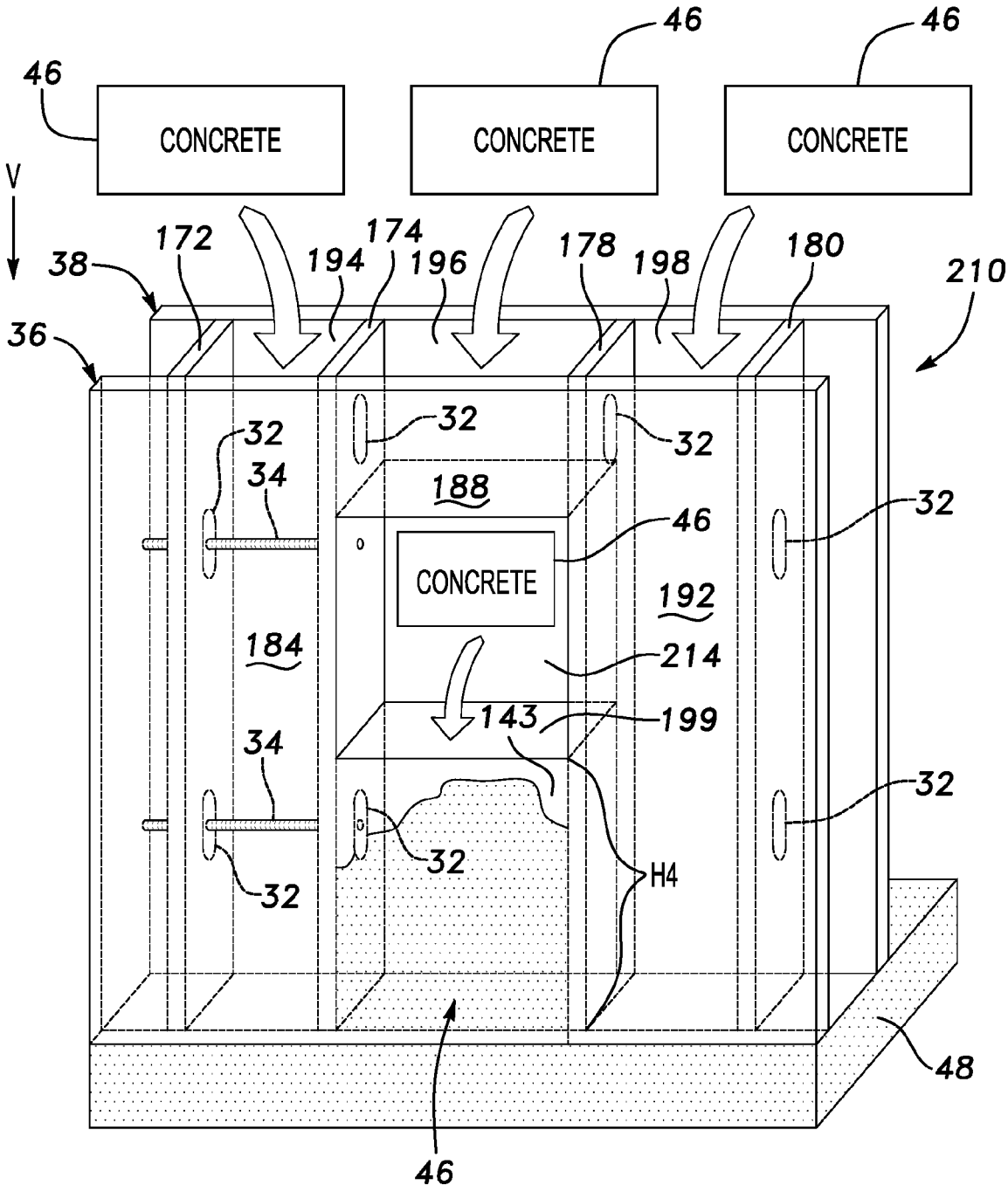
FIG. 11 illustrates the construction of a window for the inventive wall assembly.

As shown in FIG. 11, in similar fashion, concrete wall assembly 210 with window opening 214 may also be constructed. Concrete wall assembly 210 is constructed similarly to concrete wall assembly 170 of FIG. 10. However, rather than have a door opening, panels 36 and 38 are constructed to have cut-outs for window opening 214. As a consequence, fourth volume 193 is formed between second stud 174 and third stud 178 and first panel 36 and second panel 38 and footing 48. Fourth volume 193 further has opening 199 open to receive concrete 46 along a vertical direction as indicated by arrow V. Concrete may be poured in fourth value up to height H4, the anticipated height of a window sill for window opening 214. In this way, window opening 214 may be formed by first volume 184, second volume 188, third volume 192, and fourth volume 193. Again, apertures 32 through studs 172, 174, 178 and 180 may permit concrete to flow and form between these volumes so that each volume is connected by formed concrete between the volumes. In addition, reinforcing members 34 may be extended through apertures 32 to further strengthen concrete wall assembly 210.

Figure 12:
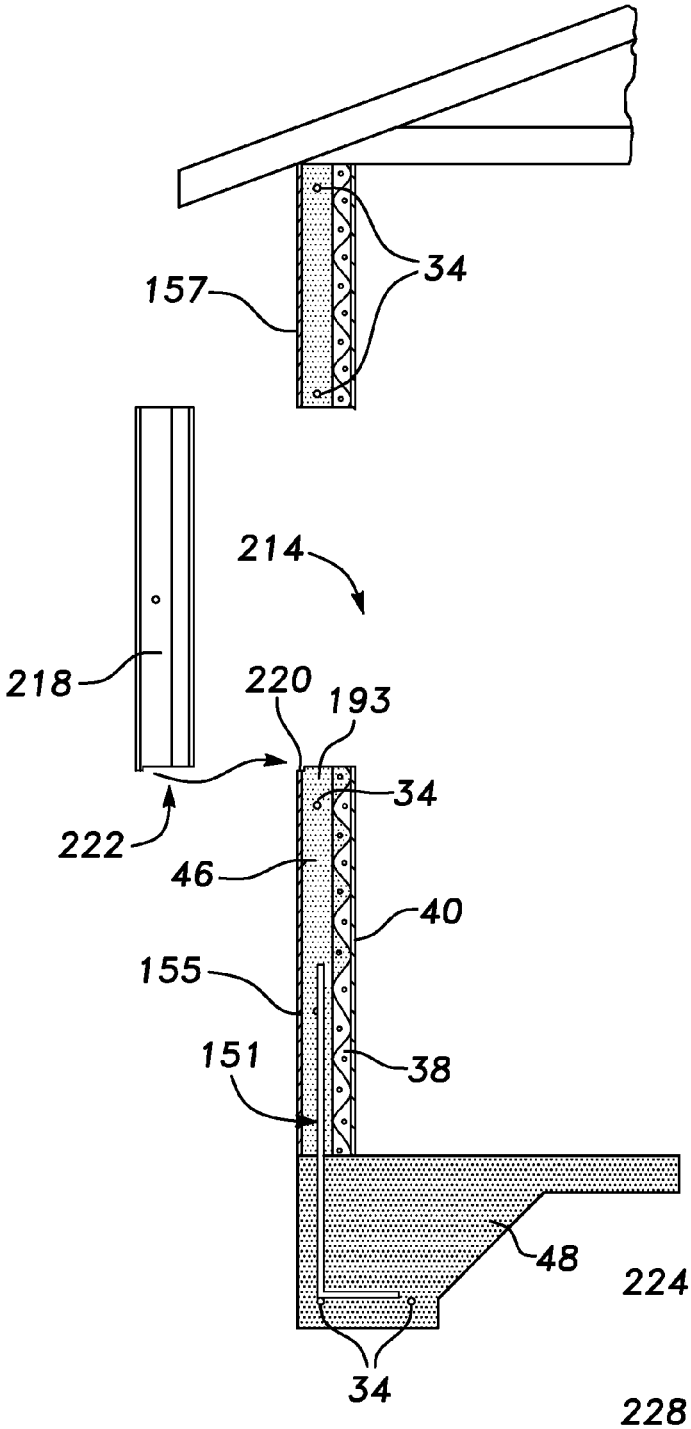
FIG. 12 illustrates a cut-away side view of a window of the inventive wall assembly.
Figure 13:
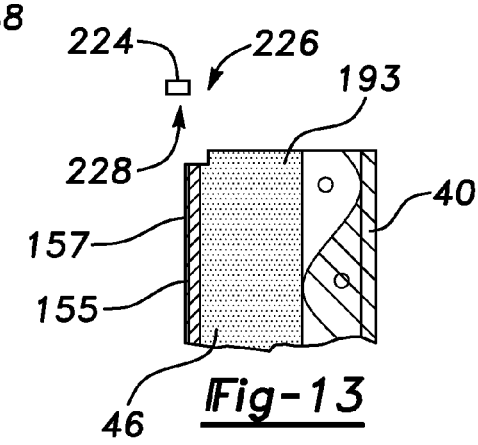
FIG. 13 illustrates an indentation to receive a window frame for the inventive wall assembly.

FIGS. 12-13 illustrate another feature of the invention that aides in the construction of a concrete wall assembly having a window opening. FIG. 12 illustrates window opening 214 as installed in concrete wall assembly 150 of FIG. 7. In addition to window opening 214, indentation 220 is placed on fourth volume 193. While window opening 214 is sized to receive window frame 218, fourth volume 193 has indentation 220 to receive flange 222 of window frame 218. In this way, window opening 214 may accommodate window frame 218 without having to remove concrete from fourth volume 193 after curing to receive this portion of window frame 218.

Referring to FIG. 13, indentation 220 is formed as follows. Block 224 is placed over fourth volume 193 prior to the pouring of concrete into fourth volume 193 at first position 226. Concrete is then poured into fourth volume 193 to the top of block 224. After concrete 46 has been cured block 224 is then removed to second position 228. Block 224 is sized of about the same dimension as flange 222 so that flange 222 may now be seated at first position 226, which block 224 once occupied.

Figure 14:
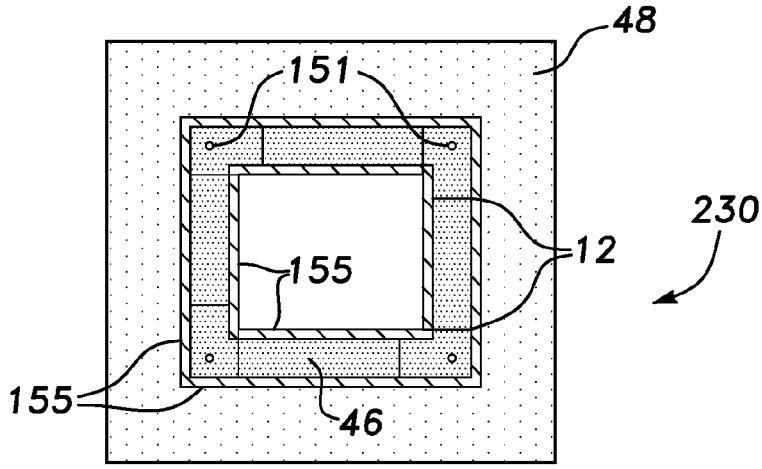
FIG. 14 illustrates an overhead view of a column according to the invention.
Figure 15:
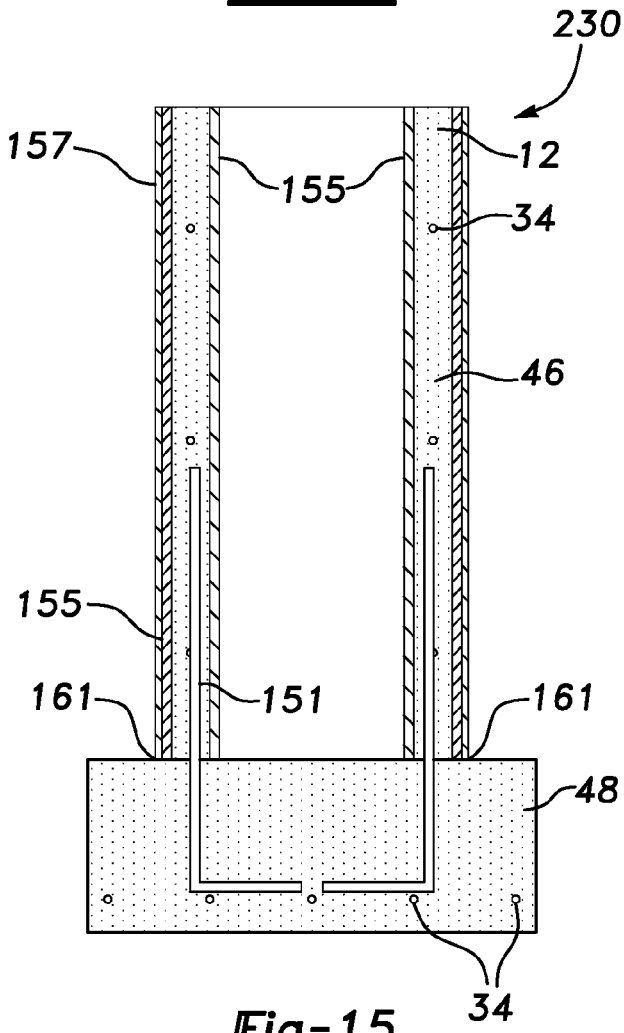
FIG. 15 illustrates a side view of the inventive column of FIG. 14.

FIGS. 14 and 15 illustrate a column constructed from the teachings of the invention. Column 230 comprises steel studs 12 spaced to form a rectangular shape. Cementitious panels 155 sandwich studs 12 to form concrete receiving cavities for concrete 46. As shown in FIG. 15, column 230 is placed on footing 48. In addition, seal 161 is placed around the periphery of column 230 to seal the interface between column 230 and footing 48. Reinforcing members 34 may be provided to secure studs to each other in a fashion previously described. In addition, reinforcing rod 151 may extend between footing 48 and column 230. Reinforcing rod 151 may be placed at each comer of column 230.

Figure 16:
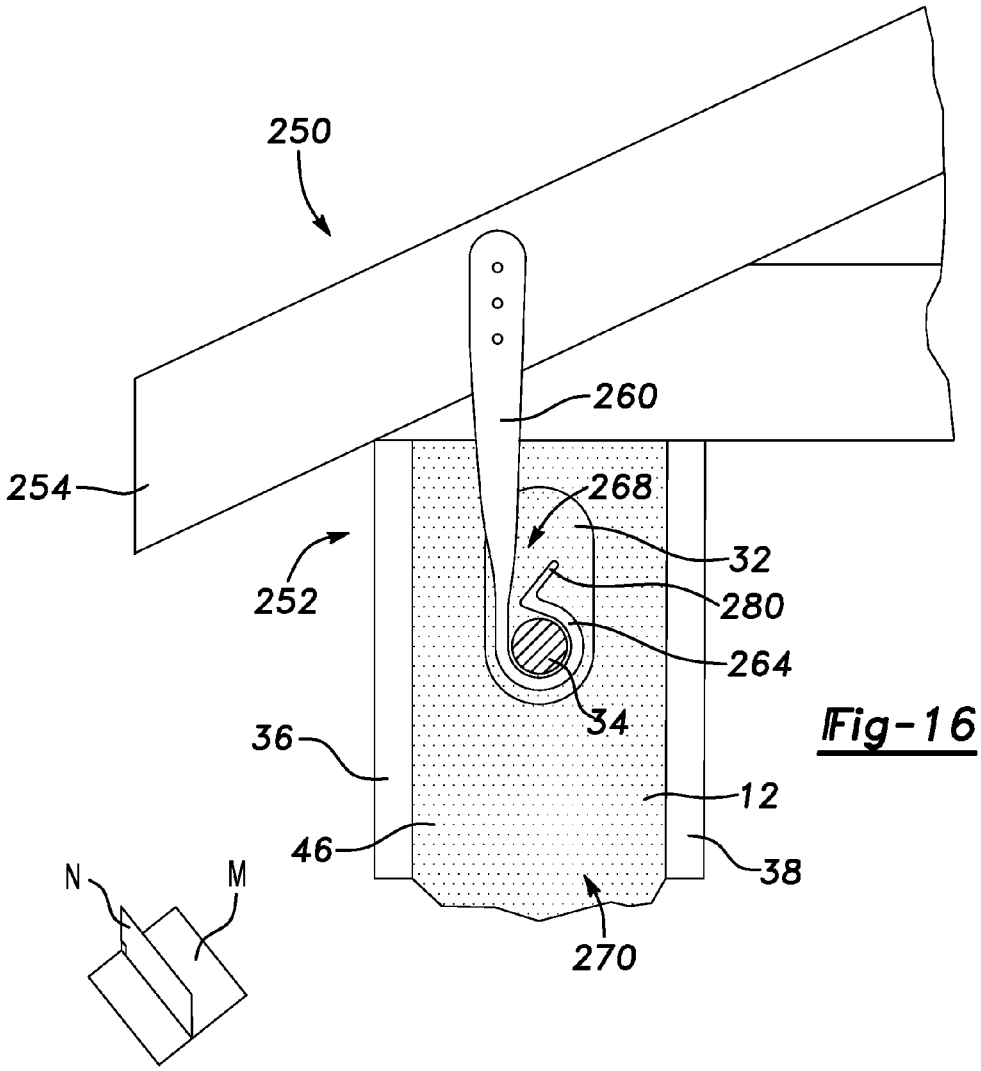
FIG. 16 illustrates a side view of a truss anchor connecting the wall assembly to a truss.

FIGS. 16-19 illustrate wall assembly 250 and connected to truss 254 for a roof. As shown in FIG. 16, truss 254 is connected to frame 252 by truss anchor 260. Frame 252 is constructed similarly to wall assembly 10 of FIG. 1. Frame 252 has first panel 36 and second panel 38 sandwiching a plurality of studs 12. Here, however, aperture 32 and reinforcing member 34 are located close to truss 254 to allow truss 254 to be anchored to frame 252. Aperture 32 permits concrete 46 to flow through studs 12 from one concrete receiving cavity to the other as shown in FIG. 1. In addition, reinforcing member 34 is provided to cross link studs 12 similarly to the connection of reinforcing member 34 of FIG. 1.

In addition, truss anchor 260 is provided and anchors reinforcing member 34 to truss 254. Because reinforcing member 34 is linked to frame 252, a secure connection is established between roof and wall. Concrete 46 is poured into concrete receiving cavity 270 so that truss anchor 260 is embedded in concrete 46 further strengthening the connection between truss 254 and frame 252.

Figure 17:
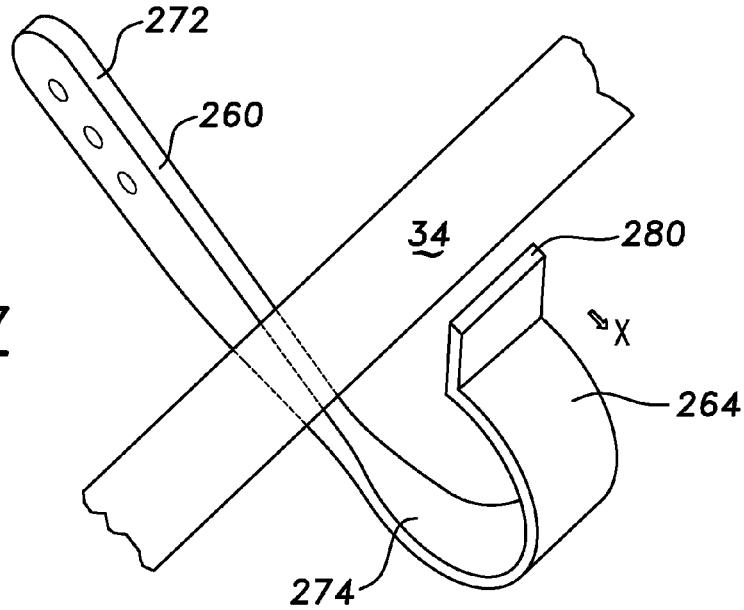
FIG. 17 illustrates a perspective view of the truss anchor of FIG. 16.

In addition, truss anchor 260 has a unique feature that permits its quick connection to reinforcing member 34. As shown in FIG. 17, truss anchor 260 comprises first portion 272 and second portion 274. First portion 272 is connected to truss 254 as shown in FIG. 16 through screws or other known connectors. First portion 272 is planar along first plane N and is perpendicular to plane M. Plane N is transverse to plane M. Second portion 274 has a planar portion that extends along plane M and is perpendicular to plane N. In this way, first portion 272 may lie flat against truss 254, while second portion 274 presents a large surface area to receive reinforcing member 34 in the direction indicated by arrow X. This feature facilities the quick installation of truss anchor 260.

Figure 18:
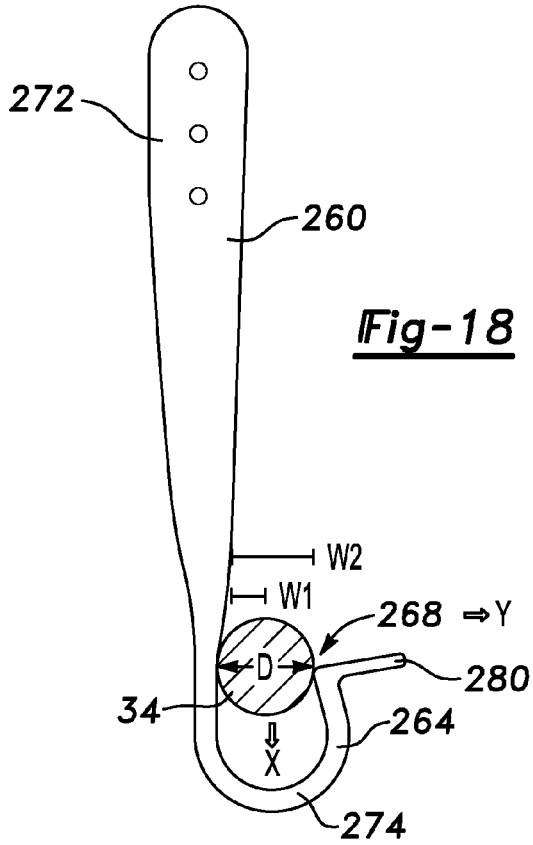
FIG. 18 illustrates a side view of the truss anchor of FIG. 17 in relation to a reinforcing member.

In addition, truss anchor 260 has hook 264 with lip 280 to receive reinforcing member 34. As shown in FIG. 18, lip 280 protrudes outward from opening 268 presenting a large surface to receive reinforcing member 34. Lip 280 is angled so that as cross member 34 moves through opening 268 along the direction of arrow X, lip 280 contacts reinforcing member 34 and causes hook 264 to move from first width W1 to larger width W2. First width W1 is smaller than diameter D of reinforcing member 34 while second width W2 is greater than diameter D. In this way, opening 268 may expand from width W1 to width W2 to receive reinforcing member 34 along the direction of arrow X as lip 280 moves in the direction of arrow Y.

Figure 19:
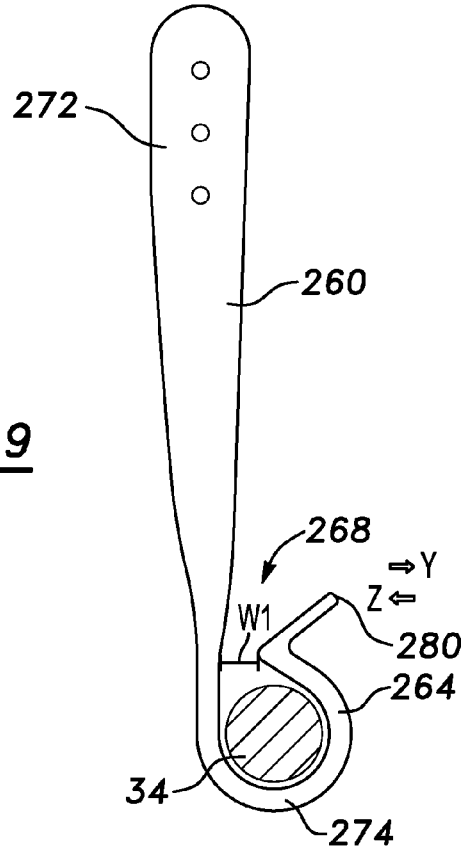
FIG. 19 illustrates a side view of the inventive truss anchor of FIGS. 17-19 with reinforcing member connected to the truss anchor.

As shown in FIG. 19, once reinforcing member 34 has passed through opening 268 into hook 264, lip 280 moves in the direction of arrow Z, a direction opposite to arrow Y from width W2 to width W1 thereby enclosing reinforcing member 34 within hook 264 and locking reinforcing member 34 to anchor 260 and ultimately to truss 254. Once hook 264 locks reinforcing member 34 in this way, truss anchor 260 may be fastened to truss 252 and concrete poured into concrete receiving cavity 270.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A concrete wall assembly comprising:

a frame comprising a plurality of studs extending along a vertical direction;

a first panel and a second panel fastened to said plurality of studs, said first panel and said second panel spanning said plurality of studs to define a concrete receiving cavity between said first panel and said second panel and said plurality of studs, wherein at least one of said first panel and said second panel comprises an insulative panel;

a port having a top and a bottom;

a port concrete receiving cavity defining at least one of said top and said bottom of said port;

wherein said port comprises a window opening, said window opening comprises a concrete indentation to receive a window frame; and a removable block for forming said concrete indentation.

2. The concrete wall assembly of claim 1 wherein said removable block is located near the lower portion of said port in a vertical direction.

3. The concrete wall assembly of claim 1 wherein said removable block is located on an exterior side of said wall assembly.

4. The concrete wall assembly of claim 1 wherein said concrete indentation is located near the lower portion of said port in a vertical direction.

5. The concrete wall assembly of claim 1 wherein said concrete indentation is located on an exterior side of said wall assembly.

6. A concrete wall assembly comprising:

a frame comprising a plurality of studs extending along a vertical direction;

a first panel and a second panel fastened to said plurality of studs, said first panel and said second panel spanning said plurality of studs to define a plurality of concrete receiving cavities between said first panel and said second panel and said plurality of studs;

a port having a top and a bottom;

at least one of said plurality of concrete receiving cavities being a port concrete receiving cavity that defines at least one of said top and said bottom of said port;

a removable block for forming a concrete indentation, said concrete indentation sized to receive a window frame; and concrete contacting a portion of said window frame.

7. The concrete wall assembly of claim 6 wherein said removable block is located near the lower portion of said port in a vertical direction.

8. The concrete wall assembly of claim 6 wherein said removable block is located on an exterior side of said wall assembly.

9. The concrete wall assembly of claim 6 wherein said concrete indentation is located near the lower portion of said port in a vertical direction.

10. The concrete wall assembly of claim 6 wherein said concrete indentation is located on an exterior side of said wall assembly.

* * * * *